United States Patent [19]

Schmitz

[11] 4,062,527

[45] Dec. 13, 1977

[54] VIBRATION DEVICE FOR SILOS FOR BULK MATERIALS

[76] Inventor: Josef Schmitz, Thyssenstrasse 44, Dinslaken, Germany, 422

[21] Appl. No.: 686,523

[22] Filed: May 14, 1976

[51] Int. Cl.[2] ..... B01F 5/26

[52] U.S. Cl. ..... 366/114; 366/128

[58] Field of Search ..... 259/DIG. 42, 72, 37; 222/198, 246, 231, 199; 198/533

[56] References Cited

U.S. PATENT DOCUMENTS

| | | | |
|---|---|---|---|
| 2,905,365 | 9/1959 | Thayer et al. | 222/198 |
| 3,715,059 | 2/1973 | Hyer | 259/DIG. 42 X |
| 3,773,231 | 11/1973 | Wahl | 222/198 |

*Primary Examiner*—Stanley H. Tollberg
*Assistant Examiner*—Norman L. Stack, Jr.
*Attorney, Agent, or Firm*—Karl F. Ross

[57] ABSTRACT

A vibration device for a silo for bulk material having a funnel-shaped delivery outlet comprises an elastically suspended support carrying a jolting motor and provided with downwardly extending guide wings in the configuration of a rosette of blades extending into the outlet passage and a cage surrounding the guide wings and formed with downwardly converging walls parallel to the walls of the delivery funnel. The cage may be provided with an array of downwardly extending rods and is supported against the sides or walls of the funnel by elastic members or buffers, the entire assembly being elastically suspended in the funnel, e.g. by tension springs. Between the jolting motor and the cage, there are provided longitudinally and torsionally elastic spring elements so that the assembly comprises two independently vibrating masses set into vibration by the jolting motor.

6 Claims, 6 Drawing Figures

VIBRATION DEVICE FOR SILOS FOR BULK MATERIALS

FIELD OF THE INVENTION

The present invention relates to a vibration device for loosening bulk material in silos equipped with a funnel-shaped delivery outlet and, more particularly, to a device for preventing the formation of, or breaking up, bridges of bulk material which tend to form in the converging passage defined by the delivery funnel.

BACKGROUND OF THE INVENTION

In silo-like storage bins, bunkers and other forms of silos for bulk material, the stored bulk material frequently tends to compact and cause blockage of the delivery funnel, thereby preventing the movement of the bulk material during its discharge or cause complete interruption of its delivery. Frequently bridges of the bulk material are formed across opposing walls of the funnel to support the mass of the bulk material in the storage bin. Below the bridge the bulk material may be drained from the funnel while the bridge supports the remainder of the bulk material and prevents its emergence.

Various vibration devices have been developed with the object of loosening the bulk material in the funnel-shaped delivery area of the silo and to break up such bridges. One conventional construction provides a frane suspended elastically in the funnel-shaped delivery passage, the frame being provided with obliquely positioned wings as well as tapered downwardly turned guide elements. A jolting motor mounted on the frame generates the desired vibration. This construction has, however, the disadvantage that the vibrations generated by the jolting motor are applied only in a horizontal direction and are transmitted only to a limited degree, by means of the wings, to the bulk material located in the region of the funnel-shaped silo wall and has to be removed from time to time by hand. The vibrations which are propagated exclusively in a horizontal direction have been found to cause a compacting of the bulk material to some extent without effecting the desired loosening and flow promotion.

OBJECTS OF THE INVENTION

It is the principal object of the present invention to provide vibration device free from the aforementioned disadvantages and capable of multiplying the vibrations of the system and generating vibrations both in a horizontal and vertical direction.

Another object of the invention is to provide an improved loosening device for bulk material which does not have a tendency to compact the bulk material by concentrating the vibrations in a horizontal direction.

SUMMARY OF THE INVENTION

These objects and others will become apparent hereinafer are attained, in accordance with the present invention, by providing a vibration device or loosening device for bulk material in a storage bin, hopper or other silo having a funnel-shaped delivery outlet which comprises, elastically suspended in the outlet, a cage having downwardly converging guide walls which can be parallel to the walls of the delivery funnel, a jolting motor mounted on a support within the funnel, and torsionally and longitudinally (vertically) elastic elements between this cage and the jolting motor support.

Advantageously, the support is provided with guide wings extending centrally of the cage downwardly in the passage so that the vibrations of the support and the vibrations of the cage can be more or less independent, the cage lying proximal to the walls of the funnel and advantageously being formed with a plurality of guide elements or cage rods which can abut the funnel walls.

According to a feature of the invention, the rods are joined elastically to the downwardly converging walls of the cage by buffer elements by which the cage is elastically supported upon the walls of the funnel. These buffer elements may be blocks of rubber. The longitudinally and torsionally effective elastic means between the cage and the motor support may be coil springs oriented with vertical axes and anchored at their opposite ends to the cage and the motor support.

Essentially, therefore, the invention comprises mounting the cage on a frame or support which is elastically suspended in the silo by means of longitudinally and torsionally elastic spring elements.

As a result of these elements, a two-mass vibration system is created, one vibration mass consisting of the motor frame or support elastically suspended in the silo while the other mass consists of the cage which is suspended from the first mass with freedom of longitudinal and torsional movement by means of longitudinally and torsionally effective elastic elements.

These two masses are caused to vibrate by the operation of the jolting motor whereby a greatly increased amplitude is generated in the resonant range. Reciprocal motions of the two vibrating masses occur periodically in the resonant range. The vibration mass formed by the cage experiences vibration in all directions resulting in an increased and improved loosening of the bulk material which tends to cling to the silo wall in the region of the delivery funnel.

The loosening force generated by the vibrations act not only in the horizontal direction but also in the vertical direction. The longitudinally and torsionally elastic mounting of the cage on the frame may be accomplished by various means although an array of coil springs with vertical axes is preferred.

Advantageously, the cage may have arms extending inwardly toward the support and preferably disposed beneath the support or frame which can have a flange from which the torsionally and longitudinally effective elastic elements depend to the arms of the cage.

For adaptation to various operating conditions and different kinds of bulk material, the spring elements are preferably designed as coil springs with an adjustable tension force. For best results, moreover, the elastic buffer elements can be disposed along the exterior surface of the inclined cage walls and can be interposed between the funnel walls and these cage walls, preferably between the cage rods and the cage walls.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
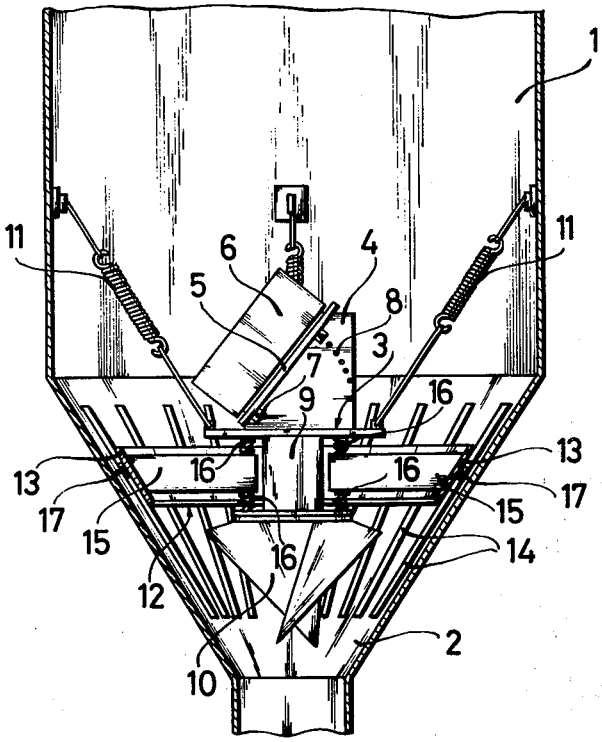
FIG. 1 is a longitudinal vertical cross section through a silo provided with the vibration device according to the present invention.
Figure 2:
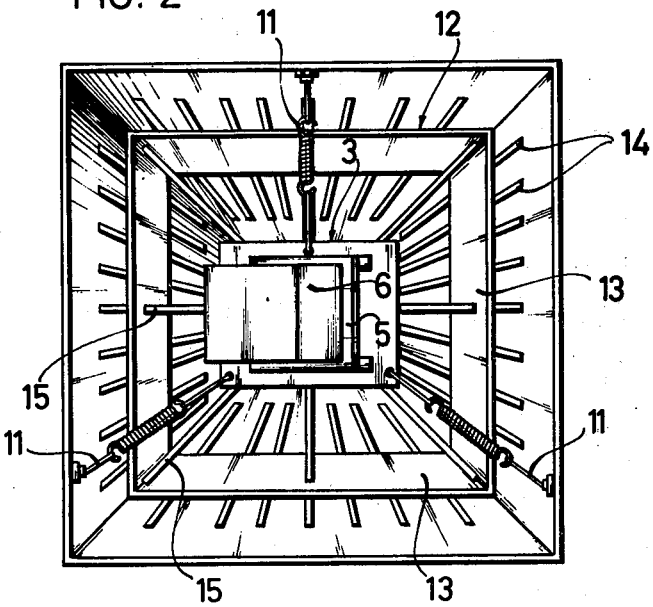
FIG. 2 is a plan view thereof.

In FIGS. 1 and 2 of the drawing, I have shown a conventional storage bin 1 provided at its lower end with a delivery funnel 2 of polyhedral construction, the funnel 2 terminating in the outlet of the hopper.

The vibration device comprises a frame or support and a cage 12 fastened to the latter in a longitudinally and torsionally elastic manner.

Two brackets 4, which carry a base plate 5 pivoting on a pin 7 are mounted on the planar frame or support 3. The brackets 4 may be provided with an array of holes 8 into which a pin 8*a* may be inserted through a lug 5*a* of the base plate 5 (see FIG. 5) to lock the base plate in various oblique positions depending upon the relative magnitudes of the vertical and horizontal components of the vibration which are desired for the particular material. As the inclination of the base plate 5 to the horizontal is reduced, the vertical jolting component increases while the horizontal jolting component is reduced. As this angle is increased, the horizontal component is increased while the vertical component is reduced.

A jolting motor 6*a* is received in the jolting motor assembly generally designated at 6 and is preferably of the polarity-reversal type. By reversing the polarity or direction of rotation of this jolting motor and by placing the latter in various oblique positions as described, it is possible to vary the nature of the vibrations and generate diagonally opposite vibrations.

Rosette-like guide wings 10, with tips turned toward the delivery end, are arranged beneath the base plate 5 on an intermediate member 9 of the support 3.

The support or frame 3 is suspended elastically within the funnel by means of three coil springs 11 anchored at one end to the walls of the hopper 1 and at the other end to the frame 3.

The cage 12 consists of four downwardly and inwardly inclined walls 13 which lie parallel to the corresponding walls of the funnel 2. The inclined walls 13 are provided externally with cage rods 14 which may have different lengths but have been illustrated, solely for the sake of simplicity, as having the same lengths in FIGS. 1 and 2.

In addition, the cage 12 is provided with inwardly extending supporting arms 15 which reach toward the support 3 but are disposed below the latter and terminate short of the intermediate member 9. Four of these supporting arms 15 run in diametrically opposite directions and diagonally across the cage. Furthermore, the arms 15 lie generally perpendicularly to the inclined walls and in respective vertical planes.

Each of the inwardly turned free ends of the supporting arms 15 is fastened by a pair of spring elements 16 below the frame 3 and to the flange of the intermediate member 8 extending below these members 15. The spring may be spring-clamped to the arms 15 or otherwise affixed thereto to apply both vertical (longitudinal) and torsional forces to the arms and thereby to the cage 12.

The spring elements 16 are preferably coil springs with adjustable tension force (see FIG. 3 and the description below). In addition, buffers 17, consisting of rubber pads, are fastened to the exterior surfaces of the inclined walls 13 by means of which the cage 12 is braced against the interior wall of the funnel 2. The rods 14 may be anchored to these buffer elements.

When the jolting motor 6 is started, vibrations, depending upon the oblique position of the latter, are transmitted vertically and horizontally to the frame 3. The vibration forces are transferred by means of the longitudinally and torsionally elastic spring elements 16 to the cage 12 which is also set in vibration. As soon as both of the vibration masses have reached their resonant frequencies, proportionally increased amplitudes are obtained which are transmitted to the bulk material and serve to loosen the latter. The cage is predominantly effective along the walls of the funnel while the support 3 and the rosette 10 are predominantly effective in the main portion of the delivery passages. As a consequence, any bridges which tend to form are destroyed before they are compacted.

Figure 3:
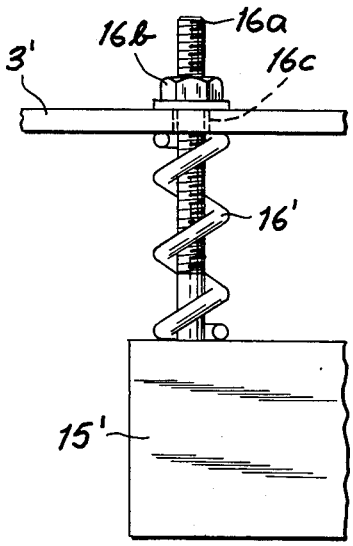
FIG. 3 is a detail view showing one system for adjusting the tension of the longitudinally and torsionally effective spring elements according to the present invention.

As can be seen from FIG. 3, the adjustment of the longitudinally and torsionally effective springs 16′ can be accomplished by passing a threaded rod 16*a*, affixed to the arm 15′, through the center of each coil spring 16′ and thence with clearance through a passage 16*c* formed in the frame 3′. A nut 16*b* is threaded onto the rod 16*a*. When the nut is tightened, the spring is longitudinally stressed.

Figure 4:
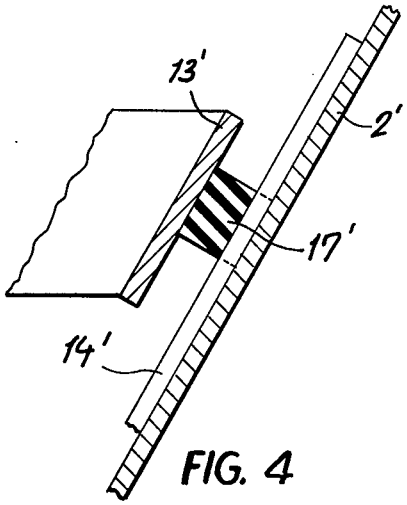
FIG. 4 is a cross section representing a detail of the buffer disposed between the cage wall and the wall of the hopper.
Figure 6:
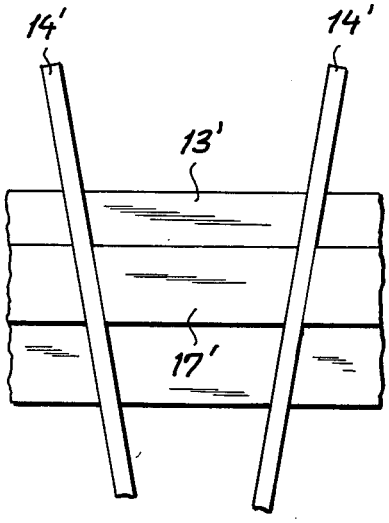
FIG. 6 is a side detail view of the buffer elements as seen from the side at which they contact the hopper wall.

FIGS. 4 and 6 show the rubber pad 17′, constituting the buffer elements, to have the cage rods 14′ recessed therein and directly abutting the walls 2′ of the funnel. The buffer elements 17′ can be adhesively bonded to the external surfaces of the inclined walls 13′ of the cage and to the rods or may frictionally receive the latter.

Figure 5:
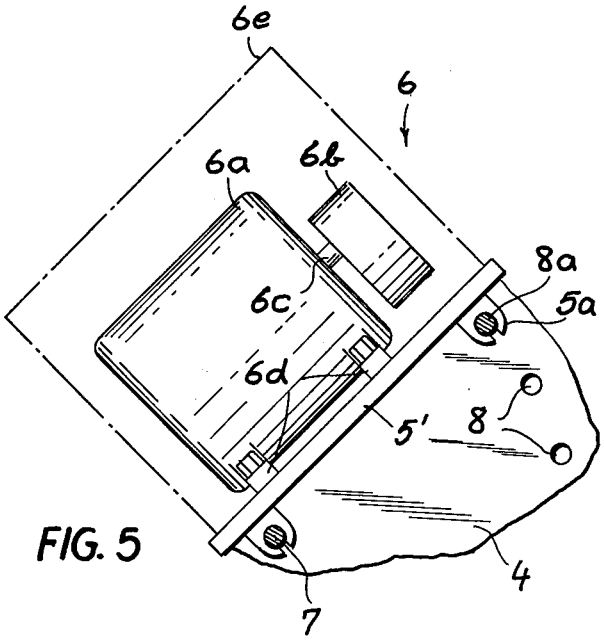
FIG. 5 is a diagrammatic view of the jolting motor with its cover removed.

In FIG. 5 I have shown the jolting motor 6*a* which has a pedestal 6*d* whereby it is bolted to the plate 5′. The motor 6*a* may have an output shaft 6*c* carrying the eccentric 6*b* which may impact against an anvil, if desired, or merely create the vibrations because of the eccentricity of its mass. The jolting motor assembly further comprises a cover 6*e* which encloses the motor and keeps the latter free from the bulk material.

Except as limited by the appended claims, the invention is not limited to the specific embodiment disclosed but may incorporate various changes without exceeding the principles of the invention. It is thurs possible, for instance, to construct the two vibration masses in a different manner and to provide them with other types of wing and grating elements. The jolting motor may also be arranged differently on the support 3 or can be mounted on the cage, transmitting torsional and longitudinal movements to the support by means of the springs 16. Furthermore, the frame or support 3 may be mounted in the hopper by more than three elastic spring members 11.

I claim:

1. A vibration device for loosening bulk material in a silo having a delivery funnel, comprising:

a support member disposed in said funnel and provided with a rosette of downwardly extending guide wings;

means elastically suspending said supports in said funnel;

a cage member surrounding said support and disposed proximal to the walls of said funnel and formed with downwardly and inwardly inclined walls;

longitudinally and torsionally elastic spring elements in the form of coil springs interposed between said cage member and said support member;

a jolting motor mounted on said support member for imparting vibration to said support member, the vibration being transmitted by said spring elements to said cage member;

elastic buffers supporting said cage member on the walls of said funnel, said cage being formed with a plurality of inwardly extending arms and said support having an intermediate portion disposed below said support and carrying said rosette of guide wings, said spring elements being disposed between said intermediate portion and said arms;

said support comprising a frame disposed above said arms, said coil springs being disposed between said frame and said arms and between said arms and said portion; and means for adjusting the tension forces of said coil springs.

2. The vibration device defined in claim 1 wherein said buffers are mounted upon exterior surfaces of the inclined walls of said cage.

3. The vibration device defined in claim 2, further comprising arrays of downwardly extending rods forming part of said cage and mounting on said inclined walls of said cage.

4. In a vibration device for loosening bulk material in a silo having a funnel-shaped outlet and comprising an elastically suspended support carrying a centrally disposed vibrating motor, a rosette array of guide surfaces extending toward the outlet, and a cage formed by arms and cage bars, and wherein the cage is supported against the silo wall by elastic buffers, the improvement and torsionally elastic spring elements.

5. The improvement defined in claim 4 wherein said arms are mounted by said longitudinally and torsionally elastic spring elements beneath said support.

6. The improvement defined in claim 5 wherein said elements are coil springs of adjustable tension.

* * * * *